United States Patent [19]

Kough et al.

[11] 4,397,129

[45] Aug. 9, 1983

[54] RESURFACING CONSTRUCTION

[75] Inventors: John K. Kough, Morgan Hill, Calif.; Otis M. Martin, 433 Chateau La Salle, San Jose, Calif. 95111

[73] Assignee: Otis M. Martin, San Jose, Calif.

[21] Appl. No.: 255,422

[22] Filed: Apr. 20, 1981

[51] Int. Cl.[3] ..... E04D 1/12

[52] U.S. Cl. ..... 52/528; 52/545

[58] Field of Search ..... 52/528, 518, 519, 540, 52/541, 545

[56] References Cited

U.S. PATENT DOCUMENTS

| | | | |
|---|---|---|---|
| 2,013,330 | 9/1935 | Abraham | 52/528 |
| 2,062,149 | 11/1936 | Stark et al. . | |
| 2,081,191 | 5/1937 | Wright . | |
| 2,116,452 | 5/1938 | Shipway . | |
| 2,151,794 | 3/1939 | Peebles . | |
| 2,226,239 | 12/1940 | Elmendorf . | |
| 2,400,357 | 5/1946 | Krajci . | |
| 2,402,731 | 6/1946 | Clements | 52/545 |
| 2,450,562 | 10/1948 | Robinson et al. . | |
| 3,054,222 | 9/1962 | Buckner | 52/545 X |
| 3,422,589 | 1/1969 | Harrison | 52/528 |
| 3,509,676 | 5/1970 | Kough et al. | 52/541 |
| 3,771,271 | 11/1973 | Keel | 52/478 |
| 3,848,384 | 11/1974 | Eaton et al. | 52/528 X |
| 3,894,376 | 7/1975 | Shearer | 52/545 X |

*Primary Examiner*—J. Karl Bell

*Attorney, Agent, or Firm*—Jack M. Wiseman; Francis W. Anderson

[57] ABSTRACT

This invention relates to the resurfacing of composition roofs and sidings, and more particularly concerns an assembly made up of a weatherproof membrane and a nailing strip secured to the membrane along one edge of the membrane so that, after the nailing strip has been nailed into the old roof, the membrane can be folded over the nailing strip to cover the strip and a portion of the old roof above the strip.

3 Claims, 8 Drawing Figures

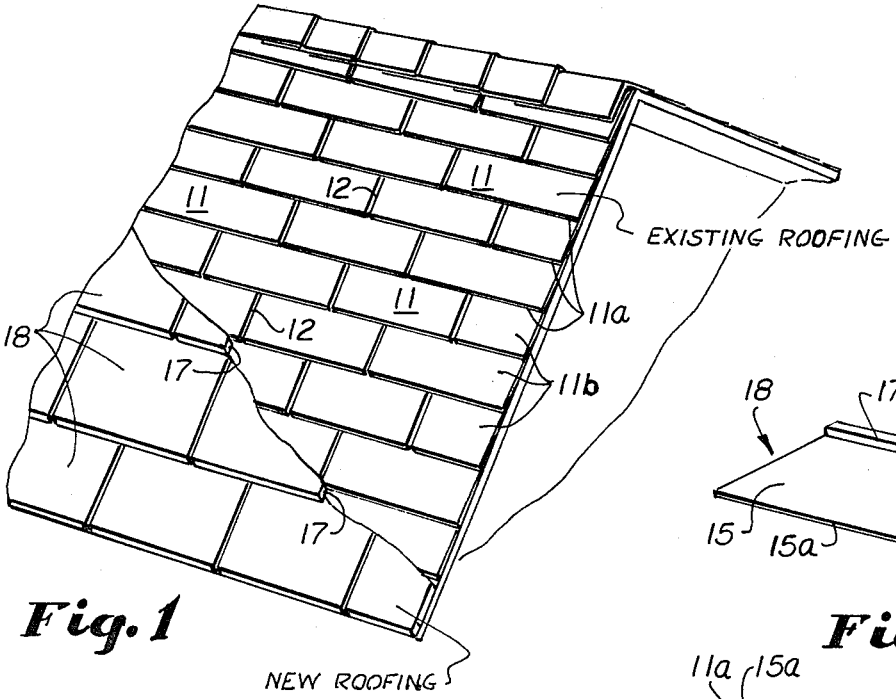
Fig. 1
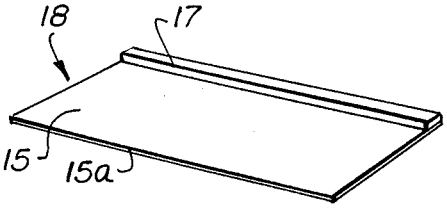
Fig. 2
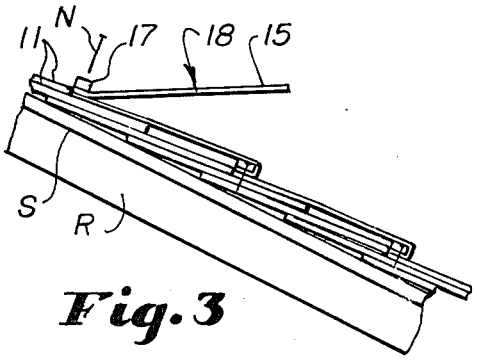
Fig. 3
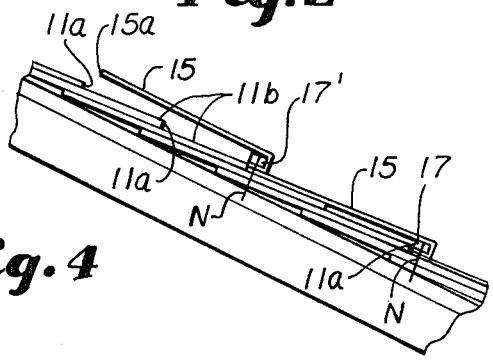
Fig. 4
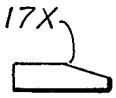
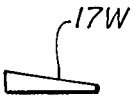
Fig. 7 Fig. 8
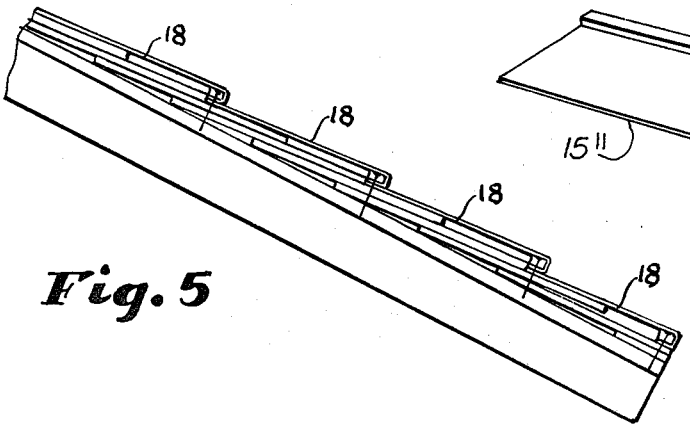
Fig. 5
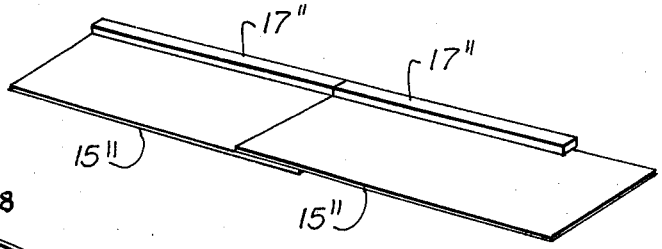
Fig. 6

RESURFACING CONSTRUCTION

BACKGROUND OF THE INVENTION

This invention concerns a method of and apparatus for resurfacing a worn composition roof or siding of buildings. In the past various materials and methods have been used to resurface existing deteriorated roofs and sidings. The most common practices have been to either tear off the old roofing or siding and apply a new covering to the structure, or to put a new composition layer directly on top of the old roofing or siding. While many homeowners would like to personally resurface their roofs or sidings, certain factors make it difficult for them when using the replacement roofing and siding that is now available. First of all the usual replacement roofing is fairly heavy and difficult for an amateur to manipulate. Secondly, it is difficult for an untrained worker to maintain the alignment of the shingles and, as a result, the finished roof or siding does not have an attractive appearance. Also it is difficult for an inexperienced worker to assure that the lower exposed ends of the shingles are sealed against the roof without nailing down these ends. Accordingly untrained persons are apt to make mistakes which allow leaks that result from sun, and driving wind and rain.

An object of the present invention is to provide a resurfacing material that is light in weight and easy to apply, and has means for aligning the individual shingles during installation and means for nailing down the lower exposed edges of the shingles.

SUMMARY OF THE INVENTION

An apparatus for resurfacing worn roofs and sidings involves an assembly of a weatherproof membrane and a nailing strip. The assembly is arranged so that, after the nailing strip and an underlying portion of the membrane is nailed onto the roof, the membrane can be folded over the nailing strip to cover the strip and the nails and to extend to an upper area where it can be covered by the nailing strip of the assembly next above.

DESCRIPTION OF THE DRAWINGS

FIG. 1 is a fragmentary schematic showing of an existing roof partly resurfaced with the material of the present invention.

FIG. 2 is a diagrammatic isometric view of one of the roofing assemblies of the present invention.

FIG. 3 is a diagrammatic fragmentary end view of a roof with the roofing assemblies of the present invention in the process of being installed thereon.

FIG. 4 is a view similar to FIG. 3 but showing the installation at a later point in the operation.

FIG. 5 is a view similar to FIG. 3 but showing a part of a completed roof and particularly illustrating the construction at the lower end of the roof.

FIG. 6 is a diagrammatic isometric view of two modified assemblies, particularly showing how the two assemblies overlap.

FIGS. 7 and 8 are enlarged end elevations of different nailing strips which can be used in the assemblies.

DESCRIPTION OF THE PREFERRED EMBODIMENT

In the upper right hand corner of FIG. 1 is illustrated schematically a typical roof over which the roofing units of the present invention may be applied. In general such a roof comprises a plurality of separate shingles 11 each shingle having a generally rectangular configuration and being about $\frac{1}{4}''$ thick. A typical shingle may be 36" long and 12" wide with one or more upwardly extending grooves on lines 12 formed therein to give the appearance that the shingle is actually several smaller shingles. When such shingles are nailed on a roof in overlapping relation, the lower edge 11*a* of the shingle is approximately 5" below the lower end of the shingle immediately above and thus each shingle has a lower section 11*b* that is about 5" high exposed to the weather.

The present invention concerns the use of a plurality of unique roofing assemblies that are secured over the shingles of an old roof, such as that shown at the upper portion of FIG. 1, to recover that roof. Each assembly 18 comprises a membrane 15 (FIG. 2) of generally rectangular configuration made of any roofing material that is weatherproof, flexible and bendable when furnished in sheets having a thickness in the range of from $\frac{1}{8}''$ to $\frac{3}{8}''$. A nailing strip 17 is secured by an adhesive to an edge portion of the membrane to form an assembly 18. Some membrane material may have a tacky surface that will adequately adhere without the use of an adhesive to the nailing which may be made of wood or a suitable plastic. The assemblies of the present invention may be furnished as units 36"×7", or 36"×12", or 36"×18". The assembly that is 7" high is used to cover one 5" course of an old roof; the assembly 12" high is used to cover two 5" courses of an old roof; and the assembly 18" high is used to cover three 5" courses of an old roof. The 12" assembly is diagrammatically illustrated in FIGS. 1–5.

The sequence of applying the assemblies 18 over the old composition shingles is schematically indicated in FIGS. 3 and 4. This procedure involves the initial step of bringing an assembly 18 into abutting contact with the lower edge 11*a* of one or more of the composition shingles 11 while the membrane 15 is in a trailing or downwardly-extending position. Depending upon the thickness of the old shingle or shake 11, both the membrane 15 and the strip 17 or only the membrane will contact the edge 11*a*. A set of nails N is driven through the nailing strip and the part of the membrane 15 secured to the underside of the nailing strip, and into the sheathing S of the roof. Next, the membrane is swung counterclockwise (FIG. 4) to wrap it around the top surface of the nailing strip, and then laid flat over the exposed areas 11*b* of the shingles 11 in the two tiers above, with the outer edge 15*a* of the membrane close to the lower edge 11*a* of the third tier above.

The nailing strip 17' of another assembly is then brought against the lower edge 11*a* of the third tier with the membrane 15' of the assembly in the trailing position shown in FIG. 3. It will be noted that when the nailing strip of the second assembly abuts the lower edge of the third tier, it overlies the upper edge portion of the membrane 15 of the first assembly 18. Nails N are driven through the nailing strip, the part of the membrane secured to the underside of the nailing strip, and the sheathing. The membrane 15' is swung counterclockwise around the nailing strip 17' and laid flat on the composition shingles of the third and fourth tiers.

FIG. 5 is a diagrammatic vertical cross-section of a typical roof having a covering of composition shingles that has been re-covered using the shingle assemblies 18 of the present invention. In many roofs having composition shingles, the lower edge of the lowermost tier of shingles terminates substantially flush with the lower edge of the sheathing and rafters as indicated in FIG. 5. Accordingly, in that case, instead of abutting the assembly against the lower edge of the lowermost shingle, it is placed over the lowermost edge with its lower edge substantially flush with the lower edge of the shingle, and nails are driven through the nailing strip and the membrane portion secured to the nailing strip and into the sheathing. When the membrane is pivoted counterclockwise and laid flat on the lower portions of the shingles of the first two tiers, it can be tucked under the shingle of the third tier a short distance. Every assembly applied to the roof above the lowermost assembly is applied following the procedure of FIGS. 3 and 4.

When assemblies 18 such as shown in FIG. 4 are applied on a roof in side-by side relation, a vertical crack is formed between the assemblies. If it is desired to eliminate this crack, the assemblies may be made as shown in FIG. 6 wherein the nailing strips 17'' are from one inch to six inches shorter than the membrane 15''. In assembly, a marginal side edge of one assembly is disposed in overlapping relation with the one alongside it. Depending upon the size of the overlap desired, the nailing strip may be from one to six inches shorter than the membrane as mentioned above.

FIGS. 7 and 8 show modified forms 17*x* and 17*w* of nailing strips.

From the foregoing description it will be evident that the present invention provides a roofing assembly that can be accurately positioned and secured over an old roof and one wherein the edges of the assemblies are tightly held down.

We claim:

1. An arrangement of resurfacing assemblies adapted for installation on top of a roof or siding that has a shingled outer surface, each assembly comprising a sheet of flexible water proof material having upper and lower margins, and a nailing strip, each sheet being positionable over the existing shingled surface with the lower margin overlying the upper margin of the sheet in the assembly next below, and its upper margin underlying the lower margin of the sheet in the assembly next above and abutting against the bottom edge of shingles in the existing roof as a guide line for installation purposes.

2. In combination in roofing assemblies adapted to be secured over an existing roof that has tiles disposed in an upwardly-inclined shingle formation, a first roofing assembly including a first weatherproof membrane of generally rectangular configuration, a nailing strip secured in abutting overlying contact to said membrane along one marginal edge of said membrane, said first membrane having a flat side edge adapted to be moved into abutting contact with the lower edge of a tile of the shingled array on the existing roof with said marginal edge of the membrane underlying said strip, means for securing said strip and said marginal edge to the roof, said membrane being made of a weatherproof material sufficiently flexible to be bent around the lower side edge of the nailing strip and over the top surface of the strip to a position wherein its unattached marginal edge portion of the membrane is adjacent the lower edge of the tile next-above on the existing roof, a second roofing assembly including a second membrane of generally rectangular configuration, a second nailing strip secured in overlying contact to a marginal edge of said second membrane, said second membrane having a flat side edge adapted to be positioned in abutting contact with the lower edge of said next-above tile of the existing roof, and with said marginal edge of said second membrane underlying said strip, and means for securing said second nailing strip to said roof with the underlying portion of said second membrane disposed over the unattached marginal edge portion of said first membrane, said second membrane being made of the same material as said first material and being adapted to be wrapped around and folded over the upper surface of said nailing strip.

3. A method of resurfacing an existing roof or siding structure having a shingled outer surface comprising the steps of moving one marginal edge of a first generally rectangular flexible waterproof membrane into abutting engagement with the downwardly directed edge surface of a shingle on a lower portion of the existing structure, securing the lower marginal portion of the membrane to the structure, positioning a second membrane on the roof at a point higher on the roof than said first membrane with its upper marginal edge in abutting engagement with the downwardly directed face of a shingle of the existing roof, and with its lower marginal portion overlying the upper marginal portion of the first membrane, and securing the overlying portions of said first and second membrane to the existing roof.

* * * * *